US011548596B2

(12) United States Patent
Hardy et al.

(10) Patent No.: US 11,548,596 B2
(45) Date of Patent: Jan. 10, 2023

(54) APPARATUS AND METHOD FOR MARINE FUELING FROM RAIL CARS ON A DOCK

(71) Applicant: GRIZZLY OIL SANDS INC., Calgary (CA)

(72) Inventors: Jacob Hardy, Calgary (CA); Glen Perry, Calgary (CA)

(73) Assignee: GRIZZLY OIL SANDS INC., Calgary (CA)

( * ) Notice: Subject to any disclaimer, the term of this patent is extended or adjusted under 35 U.S.C. 154(b) by 135 days.

(21) Appl. No.: 16/870,287

(22) Filed: May 8, 2020

(65) Prior Publication Data

US 2020/0354027 A1 Nov. 12, 2020

Related U.S. Application Data

(60) Provisional application No. 62/845,167, filed on May 8, 2019.

(51) Int. Cl.

| | |
|---|---|
| ***B63B 27/30*** | (2006.01) |
| ***B63B 25/28*** | (2006.01) |
| ***B63B 25/22*** | (2006.01) |

(52) U.S. Cl.

CPC ..... *B63B 27/30* (2013.01); *B63B 25/22* (2013.01); *B63B 25/28* (2013.01)

(58) Field of Classification Search

CPC ..... B63B 27/30; B63B 25/22; B63B 25/28; B63B 2025/087; B63B 17/0027

See application file for complete search history.

(56) References Cited

U.S. PATENT DOCUMENTS

| | | | | |
|---|---|---|---|---|
| 2,894,650 | A * | 7/1959 | Black | B65G 63/025 414/352 |
| 4,055,263 | A | 10/1977 | Freeman | |
| 4,552,082 | A * | 11/1985 | Grey | F23G 5/40 110/238 |
| 5,566,712 | A * | 10/1996 | White | F17C 13/04 62/48.1 |
| 8,375,876 | B2 * | 2/2013 | Van Tassel | F17C 13/082 114/74 R |
| 2011/0182698 | A1 * | 7/2011 | Foo | F25J 1/0278 414/803 |
| 2016/0178127 | A1 * | 6/2016 | Oh | B60S 5/02 141/98 |
| 2019/0041004 | A1 * | 2/2019 | Krueger | F17C 13/083 |

* cited by examiner

*Primary Examiner* — Gregory W Adams

(74) *Attorney, Agent, or Firm* — Bennett Jones LLP

(57) ABSTRACT

This invention provides a method and apparatus for transporting marine fuel by rail car directly to a fueling vessel, by loading rail cars loaded with marine fuel onto a specially equipped roll-on/roll-off rail barge and transporting the barge by towboat to a mooring, where it is moored/secured in position, after mooring the barge will have the capability for offloading marine fuel from its rail cars via a barge-included distribution system to fuel a vessel. The barge may operate and be regulated as a fuel terminal when secured to the mooring.

7 Claims, 3 Drawing Sheets

APPARATUS AND METHOD FOR MARINE FUELING FROM RAIL CARS ON A DOCK

BENEFIT OF EARLIER APPLICATIONS

This application claims priority from U.S. provisional application 62/845,167 filed May 8, 2019.

TECHNICAL FIELD

The present invention relates to marine barges in general, and marine fueling barges in particular.

BACKGROUND OF THE INVENTION

Conventional marine fueling operations generally comprise one of two main methods: in the first, a refinery sends its output fuel product into a tank on shore, typically by rail or pipeline. A fueling vessel then pulls up to a dock nearby to the tank on shore, and receives fuel from the tanks on shore by pipes and hoses and pumps. The fueling vessel then leaves the dock near the tank, and travels over water to meet a ship in a designated fueling mooring point within a port, where the fueling operation takes place and where the fueling vessel transfers fuel from its onboard store of fuel and into tanks or receiving means on the ship at the mooring point. The second conventional fueling method requires ships to fuel while they are moored at the ship's cargo unloading facility or dock, which must in that case also be equipped with fuel storage and handling facilities. This second case is rare as most modern ports do not allow fueling to take place at the same time or place as loading or unloading the ship's cargo, and the time and space for facilities is limited on these docks. Most typically, cargo-offloading facilities are very complex logistics operations with multiple cranes and gantries, with complex transshipment operations to, from and between truck, rail and ship. There is neither room physically nor in operational processes for ship fueling to take place.

In an example of the prior art, for instance U.S. Pat. No. 4,055,263, there is disclosed a method and system for loading freight cars while they are disposed on a barge. The boxcars in this disclosure arrive empty, and are parked on the barge, after which the barge is moved, with the empty cars, to a loading facility near to a production centre. Freight is loaded onto the box cars while they are on the barge at the production center from dockside warehouse facilities at the production centre, and then shipped over water, to a railhead (i.e. freight is loaded onto empty cars on railroad barges or railroad ferries, which are then moved to a destination railhead for further movement by rail over land). The track-carrying vessel (barge, ferry) which carries the boxcars, is also provided with a loading platform onto which forklift trucks carrying palletized freight can drive from a dockside warehouse facility associated with the production centre, and by which means the forklift trucks can move via removable runways for distribution of freight into the railway boxcars arranged in multiple rows. No boxcars are loaded prior to being loaded onto the track-carrying vessel. The loaded boxcars are driven off the vessel at the railhead and resume their voyage overland by rail to an eventual destination.

A type of vessel called roll-on/roll-off ("RORO") has been known for many years, with some examples being ferry boats designed for automobile and truck vehicles (complete with load and passengers) to "roll-on" to the ferry by a loading ramp at one terminal, be secured some way, transit a waterborne distance to a second terminal, and then "roll off" the ferry via a ramp onto land at the second terminal. RORO vessels of the prior art do not function to offload vehicle loads while away from a terminal.

The present invention aims to overcome at least some problems or limitations found in the prior art in a novel way.

SUMMARY OF THE INVENTION

It is to be understood that other aspects of the present invention will become readily apparent to those skilled in the art from the following detailed description, wherein various embodiments of the invention are shown and described by way of illustration. As will be realized, the invention is capable of other and different embodiments and its several details are capable of modification in various other respects, all within the present invention. Furthermore, the various embodiments described may be combined, mutatis mutandis, with other embodiments described herein. Accordingly, the drawings and detailed description are to be regarded as illustrative in nature and not as restrictive.

In accordance with a broad aspect of the present invention, there is provided a specially configured roll-on/roll-off railcar barge for marine fuel operations, comprising: a hull; one or more attachments for securing one or more railcars to the hull for transit; offloading equipment configured for transferring marine fuel to a visiting marine vessel; transshipment equipment attached to the hull, including a header configured for receiving marine fuel from the one or more railcars; a conduit from the header to the offloading equipment; and the conduit connected to one or more of pumping, directing, metering, and control equipment; and one or more connections between the one or more railcars and the header.

In accordance with another broad aspect of the present invention, there is provided a method for marine fueling, comprising: loading a barge, at a railhead transshipment facility, by rolling one or more railcars onto a deck of the barge, the one or more railcars being loaded with marine fuel; securing each of the one or more railcars to the barge; moving the barge to a mooring location, including orienting the barge such that at least part of offloading equipment of the barge is accessible to a visiting vessel; coupling the offloading equipment to the visiting vessel; and offloading fuel to the visiting vessel.

DESCRIPTION OF THE DRAWINGS

Referring to the drawings, several aspects of the present invention are illustrated by way of example, and not by way of limitation, in detail in the figures, wherein.

(a)

(b)

DETAILED DESCRIPTION OF THE INVENTION

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

The proposed method allows for the transfer of marine fuel from a number of loaded rail cars to marine vessels, including fueling vessels, without the requirement for an on land fuel terminal.

Figure 1:
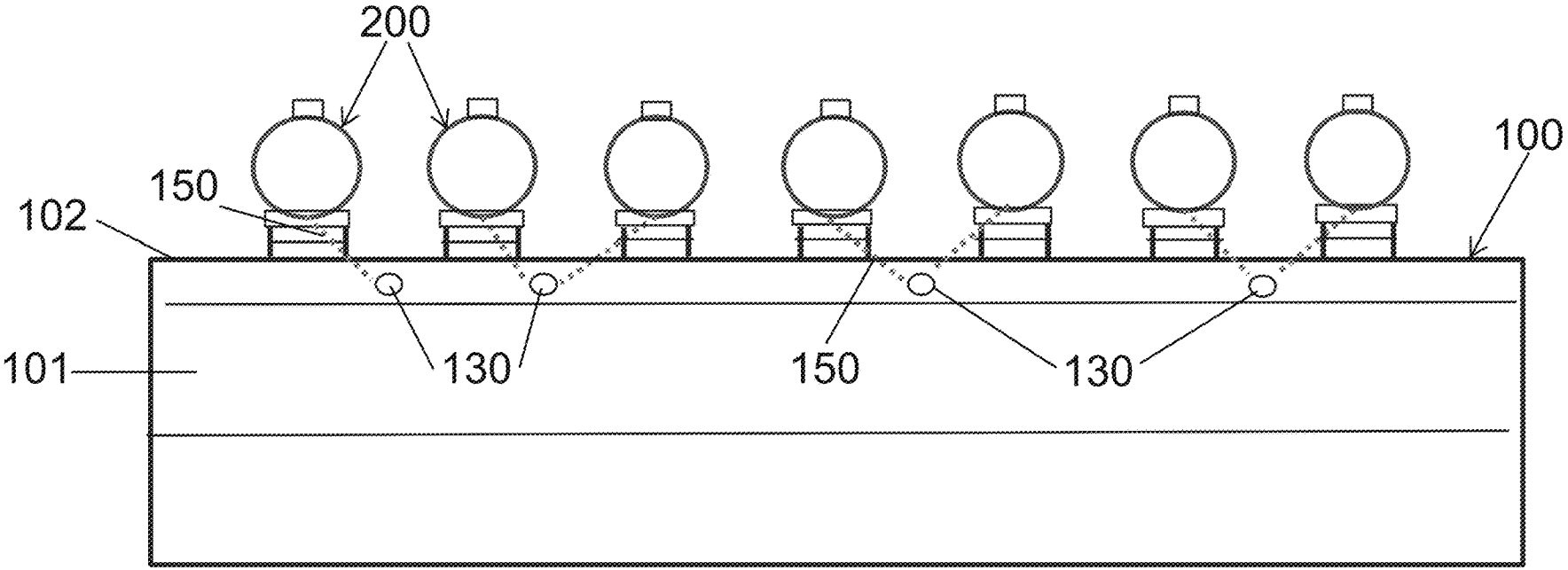
FIG. 1 is an elevation of a barge with fuel tank railcars loaded shown from one end of the barge (stern or bow), not to scale.
Figure 2:
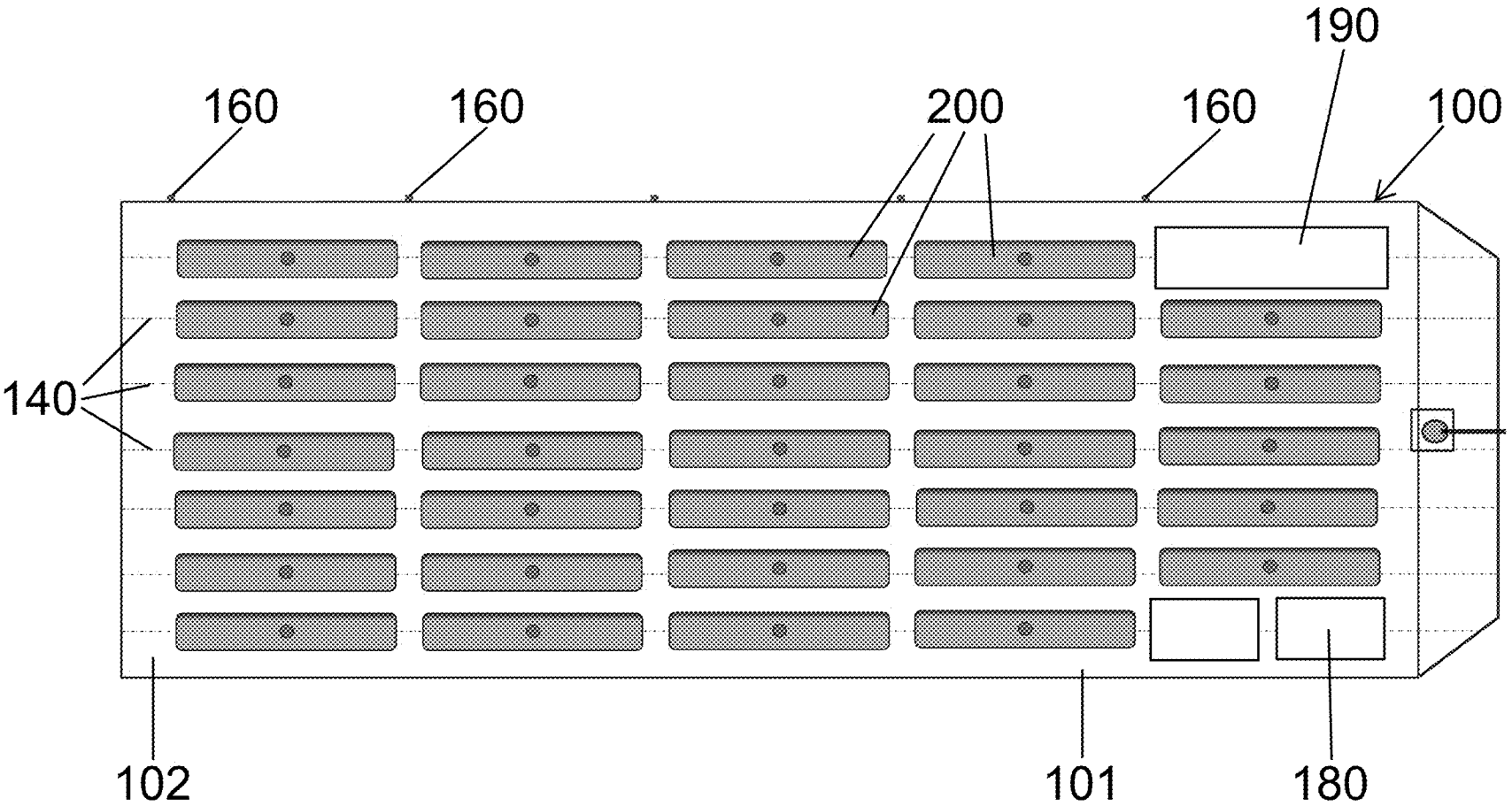
FIG. 2 is a schematic top view of a barge with fuel tank railcars on the top barge; and (c)
Figure 3:
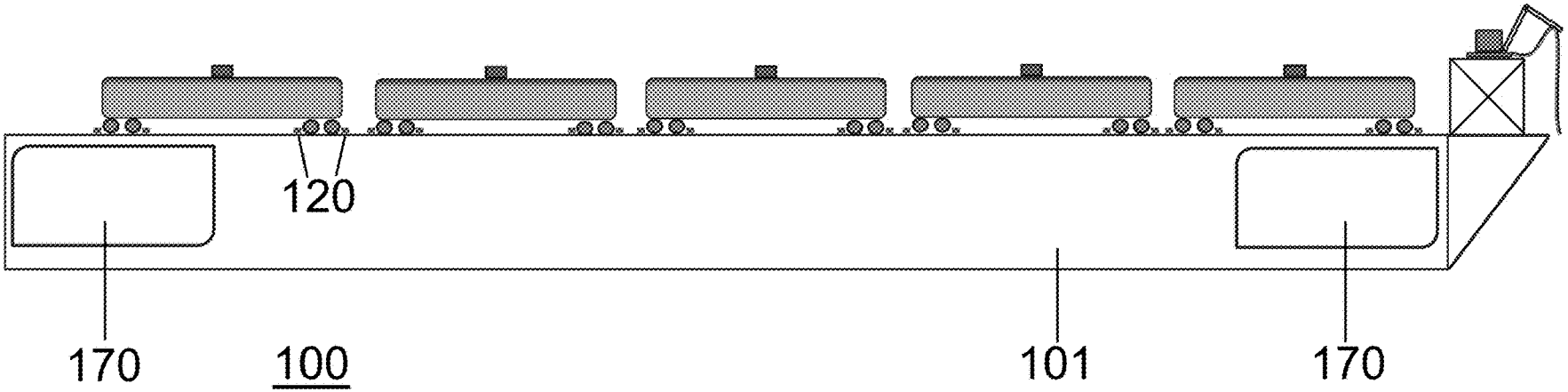
FIG. 3 is a side elevation of a barge in cutaway, showing the barge hull and the lower deck of the barge filled with fuel tank railcars, the bilge showing associated loading equipment, not to scale.

With reference to FIGS. 1-3, in one embodiment, the invention provides a specially configured roll-on/roll-off railcar barge 100 for receiving, handling, moving and then offloading railcars 200 for transport of marine fuel, the barge comprising: a hull 101 with a deck 102, attachments 120 for securing railcars to the barge for transit; at least one connection 150 for connecting at least one railcar to transshipment equipment included on the barge, the transshipment equipment including: a marine fuel receiving header 130; a conduit 140 from the header to the barge's offloading equipment, which conduit may be connected to pumping, directing, metering, and control equipment; where the offloading equipment is suitable to offload marine fuel to a visiting transient fuel vessel. The barge may also have spill containment equipment and features.

In another embodiment, the railcars loaded onto the barge are loaded with marine fuel prior to being placed onto the barge. In a further embodiment, the barge may moored before a transient fuel vessel receives marine fuel offloaded via the barge's offloading equipment.

The invention uses a proven conventional method for loading and transporting rail cars across water using existing under-utilized railhead infrastructure to load railcars which are pre-loaded with fuel directly onto a barge. The barge may then be moved to an off-shore mooring location, typically moved by tugboat or towboat, where the barge may be secured. Once secured the barge will in all relevant respects have the functionality of a fuel dock, and will have the operational capability to offload fuel from the loaded railcars directly into a transshipment system of on-board plumbing, tubing, manifolds and headers, with pumps and metering, to move the fuel from loaded cars via temporarily connected conduits and then through a metered fueling pump, and off the barge/dock to a waiting marine vessel.

The system and process of this invention allows for new or more efficient and effective access to a market for marine fuel, as currently access to fueling facilities infrastructure along the shorelines of North America (and elsewhere) are controlled primarily by refinery infrastructure operators. This method may also potentially decrease regulatory approvals process cost, complexity and associated diligence requirements, such as environmental assessment reporting requirements, which may be required for new marine fueling facilities, because most aspects of the operation of the system of this invention are already easily permitted uses under existing and expected rules, or are lightly regulated with predictable permitting requirements.

With this rail barge facility, an operator may also have the ability to economically support smaller markets (2,000-5,000 barrels per day of marine fuel, for instance) than would be required to support new fuel facilities (where the scale of the operation required to support capital and regulatory costs is much larger). Capital investment is much lower than conventional fuel terminal proposals. Also because the fueling terminal is effectively mobile, there is the potential to move the operation to any water-accessible port, depending upon demand and economics.

The invention utilizes the idea of roll-on/roll-off barge transport for railcars pre-loaded with marine fuel, the barge having on-board facilities for offloading the railcars through the barge's facilities and onward to a target fuel vessel at a dock. This invention is able to use under-utilized rail to barge loading facilities (at railheads next to water) that exist around North America (and elsewhere), which is attractive as there is then no immediate requirement for any increased rail sidings or docking facilities to accommodate the loaded cars, and there is minimal impact on current rail operations which can sometimes be a limiting factor.

Once the rail cars, which are loaded with marine fuel, are loaded on the barge using the roll-on facility and technique, the railcars are fastened securely to the barge using attachments 120, and then the barge will be towed to a mooring location where it will be properly and securely attached, and the barge will then assume the function of, and may be recognized as a "fuel dock". This dock/fueling station (that is, the moored barge with loaded railcars), will have a header system which allows for all the rail cars to offload their marine fuel in a controlled and safe manner. The header system may include connectors to attach to the cars' storage tank(s) for offloading of marine fuel from each car, as well as piping, valves, buffer storage, manifolds, pumps and control systems so that the marine fuel from a car can be moved to an offloading system for loading from the barge to a fuel vessel. This header system with have instrumentation which allows the user to control multiple products, flow rates and meter correctly. There may also be an on board steam system 190 which is sometimes required when transporting marine fuel. If some railcars are loaded with marine fuels of different characteristics, the barge may include blend facilities 180 to blend different marine fuels for specific fueling vessel offloads.

The dock/barge may contain a two stage spill containment system which can have the capacity to handle any possible spills. A first form of spill containment may be a wall around the barge which is sealed to stop any fluids from spilling off the barge. A second form of spill containment may capture fluids through grating and collect these fluids in a holding tank below deck.

The barge's offloading systems of pumps, pipes, valves, meters, etc. may also have capability of capturing off-gases from the fuel, as well as gases from a fuel vessel vented during the transport processes of loading the fuel vessel from the barge, for example by putting the vented fuel vessel vapor into the unloaded rail car's vapor or head space freed by its offloaded fuel.

An example dock may effectively have approximately 40 separate rail tank cars which act as individual tanks, and which can be fastened securely to the barge's flooring on the barge's top-most deck. An advantage of this is that the barge can thereby support the supply of multiple products and even do some blending to supply different products such as the IFO 180 and 380 fuels.

The fuel dock, which is the RORO barge, loaded with railcars which are loaded with marine fuel and specially equipped to handle the marine fuel as noted above, requires mooring dolphins and a calm area in a port but does not require any land access apart from the railhead used during RORO procedures. This may be a major advantage as the coast lines around the world are often committed and/or difficult to have new projects approved in required timelines that support economics of projects.

In one embodiment, the rail cars loaded with marine fuel are moved onto the barge using a relatively standard or conventional roll-on/roll-off configuration of tracks from conventional shore facilities at a railhead. The railcars would be rolled onto the barge's top-most deck, which may or may not be covered, and then fastened. On the next deck below, a variety of fuel-handling equipment may attach to some or all of the rail cars for offloading marine fuel from the railcars and into the barge's transloading systems. These transloading or offloading systems may include one or more of attachments to the cars' tanks or hoppers, tanks 170 for collection of fluid from headers, collection systems, storage buffering systems, transport systems (such as piping and pumps and valves), metering systems, mixing systems, and offloading systems for offloading marine fuel to a target fuel vessel.

During the roll-on phase, the barge is treated as a transport barge. Once loaded, the cars are secured and connections to the transloading systems can begin. After the cars are secured, the barge can be moved by towboat or tugged away from the railhead, and moved to a mooring off-shore. Once at the mooring, the barge is secured, the barge's offloading equipment is deployed or commissioned, and the barge becomes and is treated as a fuel dock. Fuel vessels can approach the barge as they would a fuel dock, moor to the barge as a fuel dock to receive marine fuel from the barge and its included loaded railcars by engaging the barge's offloading equipment, for example fueling connection 160, which may include a hose and a meter. In one embodiment, two or more fueling connections 160 are provided along one or both sides of the barge.

When the barge functions as a fuel dock ends (for instance, when the marine fuel is spent), the barge can again be moved by a towboat or tugged to a railhead, where the barge may again be operated as a roll-on/roll-off vessel and the railcars are rolled-off onto the railway after being properly disconnected from the barge's transshipment equipment and secure fasteners.

The process can be repeated either at the same railhead or at a different railhead. The barge can moor at any convenient and permitted mooring to function as a fuel dock.

Clauses

Clause 1. A specially configured roll-on/roll-off railcar barge for marine fuel operations, comprising: a hull; one or more attachments for securing one or more railcars to the hull for transit; offloading equipment configured for transferring marine fuel to a visiting marine vessel; transshipment equipment attached to the hull, including a header configured for receiving marine fuel from the one or more railcars; a conduit from the header to the offloading equipment; and the conduit connected to one or more of pumping, directing, metering, and control equipment; and one or more connections between the one or more railcars and the header.

Clause 2. The barge of any one or more of clauses 1-7, further comprising spill containment equipment and features.

Clause 3. The barge of any one or more of clauses 1-7, wherein the one or more railcars loaded onto the barge are loaded with fuel.

Clause 4. The barge of any one or more of clauses 1-7, wherein the transshipment equipment is configurable to mix different blends of fuel by mixing different volumes from different railcars holding fuels of differing characteristics, in order to provide specific blends of fuel to the visiting vessel.

Clause 5. The barge of any one or more of clauses 1-7, wherein the transshipment and offloading equipment includes vapor control means to remove vapor from the visiting vessel as the visiting vessel is being filled, and putting that removed vapor into a vacated tank headspace of one of the one or more railcars from which fuel has been removed.

Clause 6. A method of using the barge of any one or more of clauses 1-7 where the barge is loaded at a railhead transshipment facility by rolling loaded fuel tank railcars onto the barge, securing the railcars to the barge and to the barge's transhipment equipment, moving the barge to a location where the barge and included offloading equipment is accessible by a visiting marine vessel where the barge is moored, after which the visiting marine vessel receives marine fuel offloaded from the barge's offloading equipment.

Clause 7. A method for marine fueling, comprising: loading a barge, at a railhead transshipment facility, by rolling one or more railcars onto a deck of the barge, the one or more railcars being loaded with marine fuel; securing each of the one or more railcars to the barge; moving the barge to a mooring location, including orienting the barge such that at least part of offloading equipment of the barge is accessible to a visiting vessel; coupling the offloading equipment to the visiting vessel; and offloading fuel to the visiting vessel.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

What is claimed is:

1. A specially configured roll-on/roll-off railcar barge for marine fuel operations, comprising:

a hull including a deck;

one or more attachments on the deck for securing one or more railcars to the hull on top of the deck for transit;

offloading equipment configured for transferring marine fuel to a visiting marine vessel;

transshipment equipment attached to the hull, including a header positioned under the deck and configured for receiving marine fuel from the one or more railcars;

a below deck tank for collection of the marine fuel from the header;

a conduit to convey the marine fuel to the offloading equipment; and the conduit connected to one or more of pumping, directing, metering, and control equipment; and a plurality of connections exposed on top of the deck and coupled to the header, each of the plurality of connections configured to receive an input of marine fuel from the one or more railcars and to communicate the marine fuel to the header.

2. The barge of claim 1, further comprising spill containment equipment.

3. The barge of claim 1, wherein the one or more railcars loaded onto the barge are loaded with fuel.

4. The barge of claim 1, wherein the transshipment equipment is configurable to mix different blends of fuel by mixing different volumes from different railcars holding fuels of differing characteristics, in order to provide specific blends of fuel to the visiting vessel.

5. The barge of claim 1, wherein the transshipment and offloading equipment includes vapor control means to remove vapor from the visiting vessel as the visiting vessel is being filled, and putting that removed vapor into a vacated tank headspace of one of the one or more railcars from which fuel has been removed.

6. A method of using the barge of claim 1, wherein the barge is loaded at a railhead transshipment facility by rolling loaded fuel tank railcars onto the barge, securing the railcars to the barge and to the barge's transhipment equipment, moving the barge to a location where the barge and included offloading equipment is accessible by a visiting marine vessel where the barge is moored, after which the visiting marine vessel receives marine fuel offloaded from the barge's offloading equipment.

7. A method for marine fueling, comprising:

loading a barge, at a railhead transshipment facility, by rolling one or more railcars onto a deck of the barge, the one or more railcars being loaded with marine fuel;

securing each of the one or more railcars to the deck of the barge;

connecting each of the one or more railcars to a connection that is exposed on the deck and that is coupled to a header mounted below the deck and in fluid communication with a below deck tank;

offloading the marine fuel from the one or more railcars through the connection and into the header and the below deck tank;

moving the barge to a mooring location, including orienting the barge such that at least part of offloading equipment of the barge is accessible to a visiting vessel;

coupling the offloading equipment to the visiting vessel; and offloading the marine fuel from the barge to the visiting vessel.

* * * * *